United States Patent [19]

Akabane et al.

[11] Patent Number: 4,619,083

[45] Date of Patent: Oct. 28, 1986

[54] GRINDING METHOD OF ROUNDED ANNULAR CORNER ON WORKPIECE

[75] Inventors: Hitoshi Akabane, Anjoh; Gen Ishiyama, Kariya, both of Japan

[73] Assignee: Toyoda Koki Kabushiki Kaisha, Kariya, Japan

[21] Appl. No.: 712,093

[22] Filed: Mar. 15, 1985

[30] Foreign Application Priority Data

Mar. 19, 1984 [JP] Japan ..... 59-52680

[51] Int. Cl.[4] ..... B24B 1/00

[52] U.S. Cl. ..... 51/289 R; 51/327

[58] Field of Search ..... 51/289 R, 327, 326, 51/105 SP, 105 R, 165 R

[56] References Cited

U.S. PATENT DOCUMENTS 4,337,599 7/1982 Koide et al. ..... 51/165.87

4,510,719 4/1985 Yoneda et al. ..... 51/289

FOREIGN PATENT DOCUMENTS 56-3168 1/1981 Japan .

OTHER PUBLICATIONS

Werkstatt und Betrieb 110(1977)8, "Einsatz von NC--Rundschleif-Maschinen," by Ulrich Vetter, pp. 475–477, particularly Bild 3.

Instruction Manual "Automatic Computer Control Step-Master and Plunge-Master Grinding Systems," by the Warner & Swasey Co., FIG. 1, pp. 6-1.

*Primary Examiner*—Frederick R. Schmidt

*Assistant Examiner*—Robert A. Rose

*Attorney, Agent, or Firm*—Oblon, Fisher, Spivak, McClelland & Maier

[57] ABSTRACT

A method of grinding a rounded annular corner formed between a cylindrical portion of a workpiece and a shoulder portion adjacent to the cylindrical portion, an apex portion of a grinding wheel is first positioned at a starting point to be in contact with a surface of the rounded annular corner and is subsequently moved along the surface of the rounded annular corner from the starting point to a terminal point where the shoulder portion is ground by the grinding wheel. During the movement of the grinding wheel from the starting point to the terminal point, the surface of the rounded annular corner is ground by the apex portion of the grinding wheel. When moved to the terminal point, the apex portion of the grinding wheel is retracted radially outwardly from the terminal point to an escape point where the apex portion is spaced from the outer periphery of the shoulder portion. Subsequently, the apex portion of the grinding wheel is returned in a reverse direction from the escape point to the terminal point and is further moved along the ground surface of the rounded annular corner toward the starting point.

3 Claims, 6 Drawing Figures

GRINDING METHOD OF ROUNDED ANNULAR CORNER ON WORKPIECE

BACKGROUND OF THE INVENTION

1. Field of the Invention

The present invention relates to a method of grinding a rounded annular corner formed between a cylindrical portion of a workpiece and a shoulder portion adjacent to the cylindrical portion, and more particularly to a method of grinding the rounded annular corner of the workpiece by a grinding wheel whose rotation axis is arranged across the rotation axis of the workpiece.

2. Description of the Background

In FIG. 1 there is illustrated a conventional method of grinding a rounded annular corner Wc formed between a cylindrical portion Wa of a workpiece W and a shoulder portion Wb adjacent and perpendicular to the cylindrical portion Wa, wherein an apex portion Gp of a grinding wheel G is first positioned at a starting point Pa and is subsequently moved along a finish surface Sc of the rounded annular corner Wc toward a terminal point Pb to successively grind the rounded annular corner Wc and shoulder portion Wb of workpiece W. When the apex portion Gp of grinding wheel G has arrived at the terminal point Pb, the grinding wheel G is moved in a reverse direction at the terminal point Pb to return along the ground surface Sc of rounded annular corner Wc toward the start point Pa. During such a grinding process, it has been experienced that the grinding wheel G cuts into the shoulder portion Wb of workpiece W in its reverse movement at the terminal point Pb, resulting in grinding burn or seizure at the shoulder portion Wb of workpiece W. This problem is caused by the fact that immediately after reversed at the terminal point Pb, the return movement of grinding wheel G toward the starting point Pa is inevitably delayed due to a lapse of time for reverse feed of the grinding wheel and the return movement of workpiece W is also inevitably delayed due to a lapse of time for reverse feed of the workpiece. Since the feed screw shaft for the workpiece is longer than the feed screw shaft for the grinding wheel, the delay in reverse movement of the workpiece W becomes larger than that in reverse movement of the grinding wheel G. In the occurrence of such delays in relative reverse movement of the grinding wheel and the workpiece, the grinding wheel W is deviated from its return path toward the starting point Pa and cuts into the shoulder portion Wb of workpiece W.

SUMMARY OF THE INVENTION

It is, therefore, a primary object of the present invention to provide an improved method capable of grinding a rounded annular corner of a workpiece in a precise manner without causing any grinding burn at a shoulder portion of the workpiece.

According to the present invention briefly summarized, the primary object is accomplished by providing a method of grinding a rounded annular corner formed between a cylindrical portion of a workpiece and a shoulder portion adjacent to the cylindrical portion, wherein an apex portion of a grinding wheel is first positioned at a start point to be in contact with a surface of the rounded annular corner and is subsequently moved along the surface of the rounded annular corner from the start point to a terminal point where the shoulder portion is ground by the grinding wheel. During the movement of the grinding wheel from the starting point to the terminal point, the surface of the rounded annular corner is ground by the apex portion of the grinding wheel. When moved to the terminal point, the apex portion of the grinding wheel is retracted radially outwardly from the terminal point to an escape point where the apex portion of the grinding wheel is spaced from the shoulder portion of the workpiece. Subsequently, the apex portion of the grinding wheel is moved in a reverse direction at the escape point and returned to the terminal point. Thereafter, the apex portion of the grinding wheel is further moved along the ground surface of the rounded annular corner of the workpiece from the terminal point to the starting point.

BRIEF DESCRIPTION OF THE DRAWINGS

The foregoing object and other objects, features and attendant advantages of the present invention will be readily appreciated as the same becomes more clear from the following detailed description of preferred embodiments thereof, when considered with reference to the attached drawings, in which.

DESCRIPTION OF THE PREFERRED EMBODIMENTS

Figure 1:
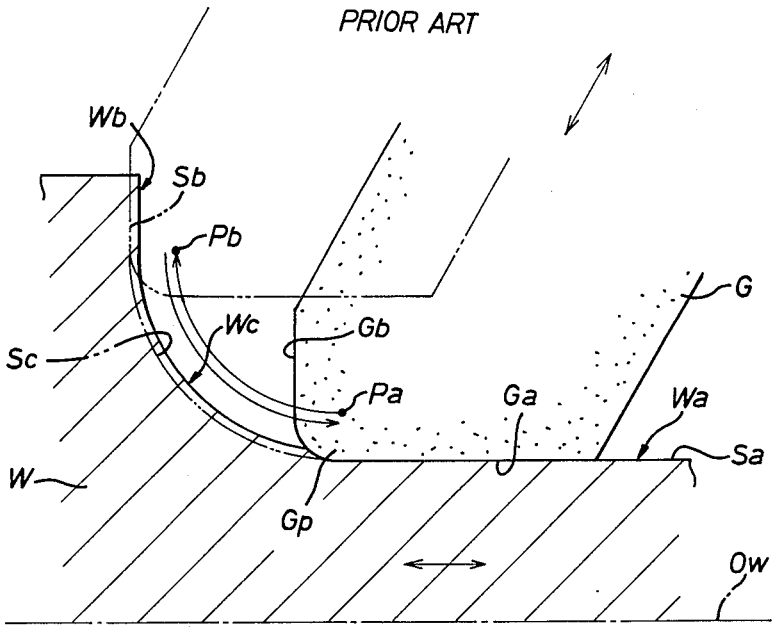
Fig. 1 PRIOR ART
FIG. 1 illustrates a conventional grinding method of a rounded annular corner formed on a workpiece.
Figure 2:
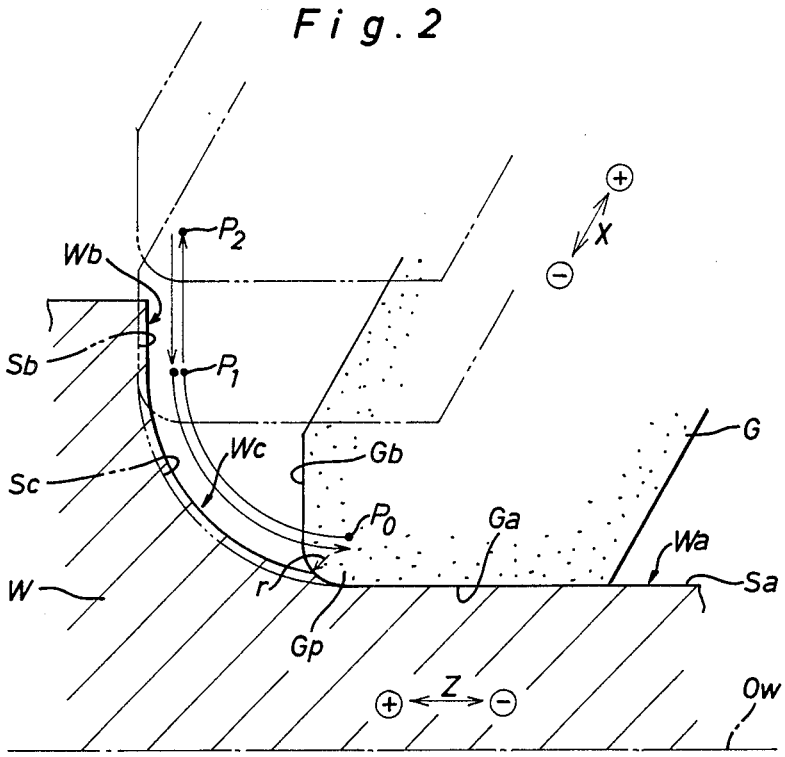
FIG. 2 illustrates an improved grinding method of the rounded annular corner in accordance with the present invention.

Referring now to the attached drawings, wherein like reference numerals or characters indicate identical or corresponding parts throughout the several views. In FIG. 2 there is illustrated a method of grinding a rounded annular corner Wc of a workpiece W in accordance with the present invention. In the figure, a moving path of a grinding wheel G in an X-axis direction makes an acute angle with the axis Ow of the workpiece W. The grinding wheel G is formed at its outer periphery with a first grinding surface Ga in parallel with the axis Ow of workpiece W and a second grinding surface Gb perpendicular to the first grinding surface Ga. Formed between both the grinding surfaces Ga and Gb is an apex portion Gp of grinding wheel G the radius of which is indicated by the reference character r.

In a cycle of grinding the rounded annular corner Wc of workpiece W, the grinding wheel G is first positioned at a starting point Po where the apex portion Gp of grinding wheel G is in contact with a finish surface Sc of the rounded annular corner Wc adjacent to the cylindrical portion Wa. Subsequently, a first relative movement between the rotating grinding wheel and the rotating workpiece is effected to move the apex portion Gp of grinding wheel G along the surface Sc of rounded annular corner Wc to a terminal point $P_1$. During the movement of grinding wheel G from the start point $P_0$ to the terminal point $P_1$, the rounded annular corner Wc of workpiece W is ground along its surface Sc by means of the apex portion Gp of grinding wheel G, and subsequently the shoulder portion Wb of workpiece W is ground by the second on shoulder grinding surface Gb of grinding wheel G. After being moved to the terminal point $P_1$, the grinding wheel G is radially outwardly retracted from the shoulder portion Wb of workpiece W in a direction perpendicular to the axis Ow of workpiece W. When retracted to an escape point $P_2$, the second grinding surface Gb of grinding wheel G is spaced from the shoulder portion Wb of workpiece W. At the escape point $P_2$, the grinding wheel G is moved in a reverse direction and is subsequently returned to the terminal point $P_1$. Thereafter, a second relative movement between the rotating grinding wheel and the rotating workpiece is effected to move the apex portion Gp of grinding wheel G along the ground surface Sc of rounded annular corner Wc to the starting point $P_0$. During the return movement of grinding wheel G, the ground surfaces of shoulder portion Wb and rounded annular corner Wc are finished in a precise manner.

As is understood from the above description, the grinding method of the present invention is characterized in that after being spaced from the shoulder portion Wb of workpiece W at the escape point $P_2$, the grinding wheel G is moved in the reverse direction. It is, therefore, to be noted that even if the grinding wheel G was deviated from its return path at the escape point $P_2$, the second grinding surface Gb of grinding wheel G would not cut into the shoulder portion Wb of workpiece W. As a result, the workpiece W is ground in a precise manner without causing any grinding burn at the shoulder portion Wb of workpiece W.

Figure 3:
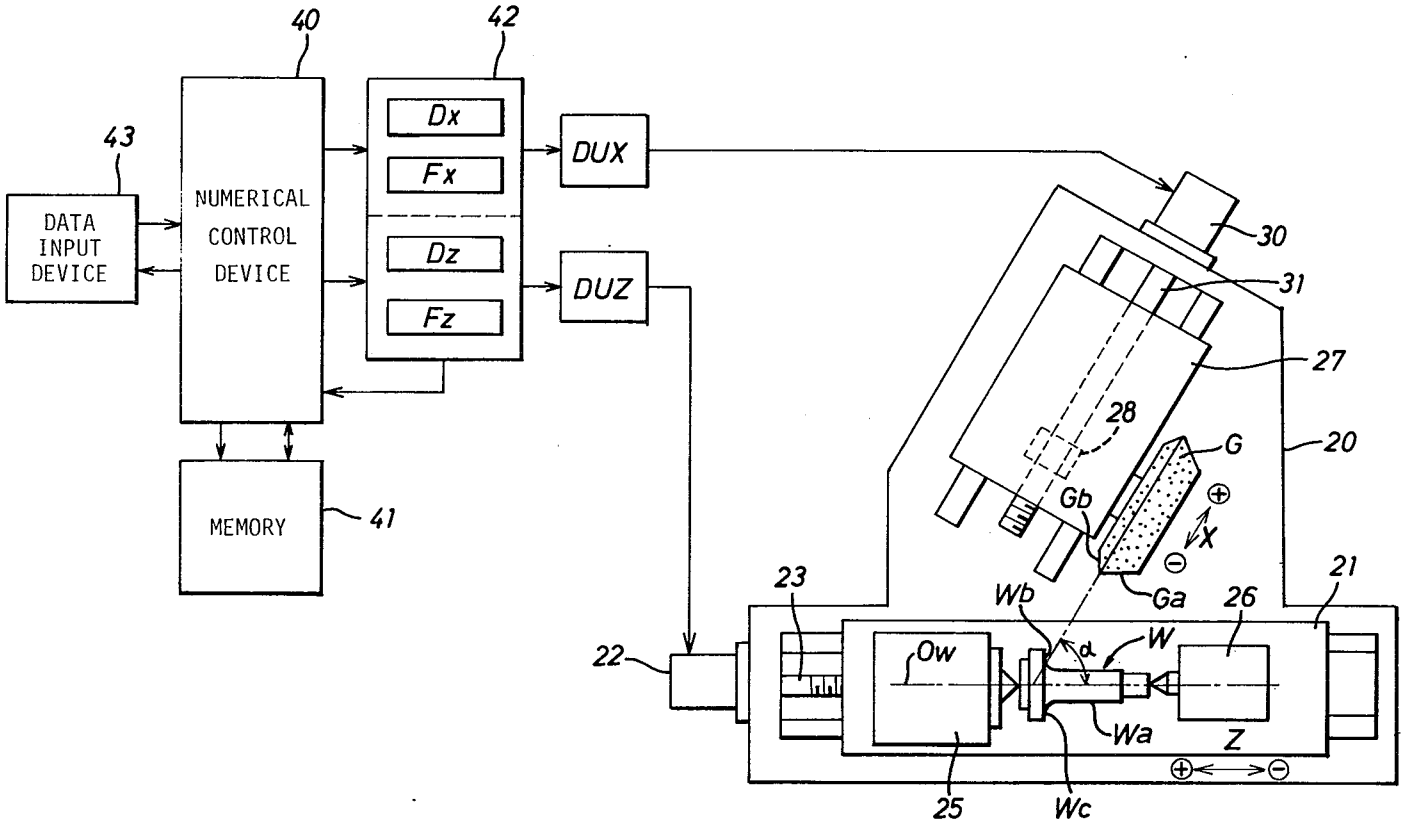
FIG. 3 is a plan view of a grinding machine connected to a numerical control device therefor for performing the improved grinding method shown in FIG. 2.
Figure 5:
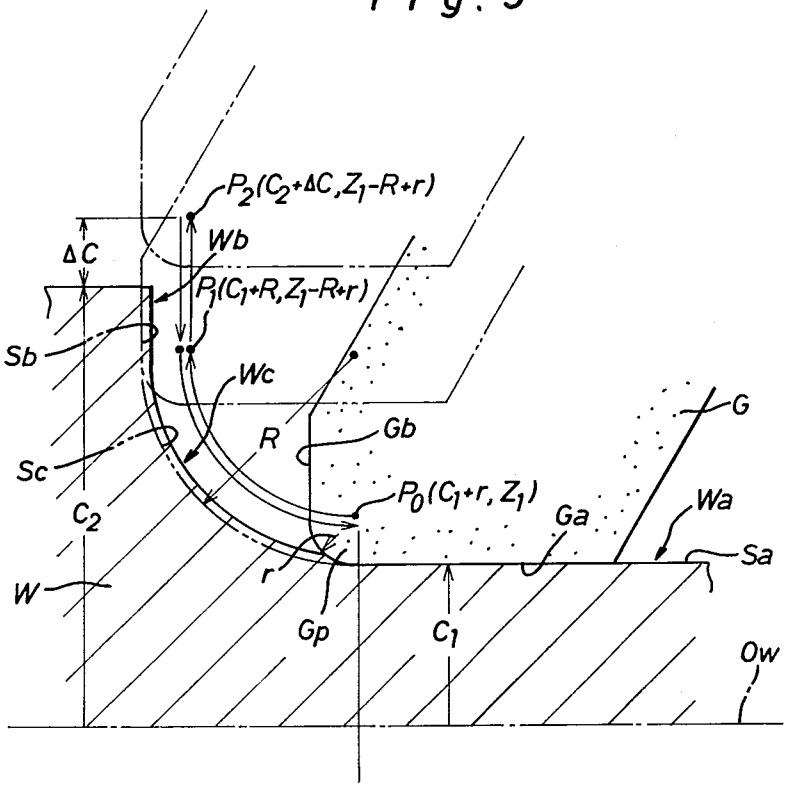
FIG. 5 illustrates moving paths of a grinding wheel in operation of the grinding machine shown in FIG. 3.
Figure 4:
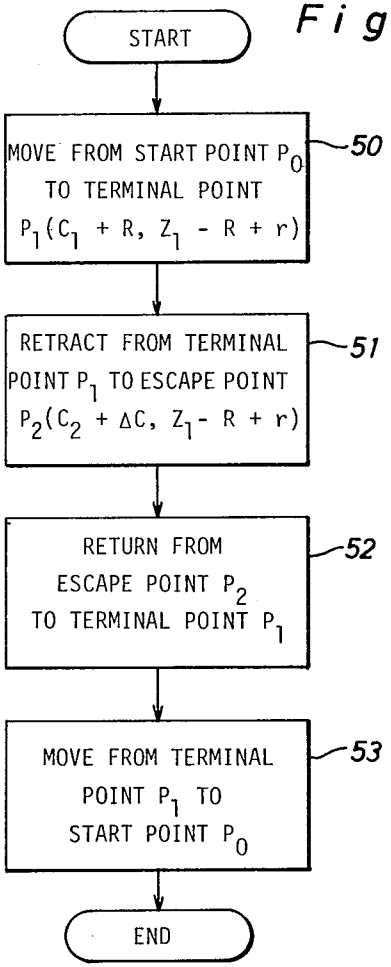
FIG. 4 is a flow chart to be executed by the numerical control device.

Hereinafter, a grinding machine for performing the foregoing grinding method will be described in detail with reference to FIGS. 3–5. As is illustrated in FIG. 3, the grinding machine comprises a bed 20, a work table 21 mounted on the front portion of bed 20 to be slidable in a Z-axis direction through a pair of guide ways. The work table 21 is threadedly engaged with a feed screw shaft 23 which is drivingly connected to a servo motor 22. A headstock 25 and a tailstock 26 are mounted on the work table 21 to rotatably support a workpiece W having a rounded annular corner Wc formed between a cylindrical portion Wa and a shoulder portion Wb. The grinding machine further comprises a wheel head 27 slidably mounted on the bed 20 through a pair of guide ways and a grinding wheel G mounted on the wheel head 27 to be rotated by a drive motor (not shown) in a usual manner. The wheel head 27 is threadedly engaged with a feed screw shaft 31 which is drivingly connected to a servo motor 30 through a gearing mechanism (not shown). The grinding wheel G is formed at its outer periphery with a first grinding surface Ga for grinding the cylindrical portion Wa of workpiece W, a second grinding surface Gb for grinding the shoulder portion Wb of workpiece W, and an apex portion Gp between the grinding surfaces Ga and Gb. In such an arrangement, the wheel head 27 is moved in an X-axis direction extending across the Y-axis at an acute angle.

A numerical control device 40 for the grinding machine is in the form of a microcomputer which includes a central data processing unit or CPU connected to a memory 41, a pulse generator 42, and a data input device 43. The data input device 43 is arranged to enter therein numerical control data required for grinding the workpiece W, and the memory 41 is arranged to store the numerical control data applied therein from data input device 43 under control of the CPU. A flow chart of FIG. 4 schematically illustrates a program determined on a basis of the stored numerical control data in memory 41. The CPU is arranged to execute the program so as to determine each feed amount of the work table 21 and the wheel head 27 as will be described later. The pulse generator 42 includes internal registers Dx, Fx, Dz and Fz which are applied with output signals indicative of the respective feed amounts from the CPU to distribute pulses to the drive units DUX and DUZ for activating the servo motors 30 and 22.

In operation of the grinding machine, the pulse generator 42 is responsive to the output signals from the CPU to distribute pluses to the drive units DUX and DUZ so as to effect initial relative movement between the work table 21 and the wheel head 27. Thus, as is illustrated in FIG. 5, the apex portion Gp of grinding wheel G is first positioned at a start point $P_0(C_1+r, Z_1)$, where the character $C_1$ is a radius of the cylindrical portion Wa, the character r is a radius of the apex portion Gp, and the character $Z_1$ is a point on a coordinate axis in parallel with the Z-axis. When the program proceeds to a step 50 in the flow chart of FIG. 4, the CPU determines first feed amounts for the work table 21 and the wheel head 27 to effect movement of the apex portion Gp of grinding wheel G along a finish surface Sc of the rounded annular corner Wc from the starting point $P_0$ to a terminal point $P_1(C_1+R, Z_1-R+r)$. In the figure, the character R is a radius of the finish surface Sc of rounded annular corner Wc. Thus, the pulse generator 42 distributes pulses to the drive units DUX and DUZ in response to output signals indicative of the first feed amounts from the CPU to effect relative movement between the work table 21 and the wheel head 27 for moving the apex portion Gp of grinding wheel G along the finish surface Sc of rounded annular corner Wc.

When the apex portion Gp of grinding wheel G has been moved to the terminal point $P_1$, the program proceeds to a step 51 where the CPU determines second feed amounts for the work table 21 and the wheel head 27 to effect movement of the apex portion Gp of grinding wheel G from the terminal point $P_1$ toward an escape point $P_2(C_2+\Delta C, Z_1-R+r)$. In the figure, the character $C_2$ is a radius of the shoulder portion Wb of workpiece W, and the character $\Delta C$ is a distance between the escape point $P_2$ and the outer periphery of shoulder portion Wb. Thus, the pulse generator 42 distributes pulses to the drive units DUX and DUZ in response to output signals indicative of the second feed amounts from the CPU to effect relative movement between the work table 21 and the wheel head 27 for retracting the apex portion Gp of grinding wheel G radially outwardly from the terminal point $P_1$ to the escape point $P_2$. When the apex portion Gp of grinding wheel G has been retracted to the escape point $P_2$, the program proceeds to a step 52 where the CPU determines third feed amounts for the work table 21 and the wheel head 27 to effect reverse movement of the apex portion Gp of grinding wheel G toward the terminal point $P_1$ at the escape point $P_2$. Thus, the pulse generator 42 distributes pulses to the drive units DUX and DUZ in response to output signals indicative of the third feed amounts from the CPU to effect relative movement between the work table 21 and the wheel head 27 for moving the apex portion Gp of grinding wheel G from the escape point $P_2$ to the terminal point $P_1$.

When the apex portion Gp of grinding wheel G has been returned to the terminal point $P_1$, the program proceeds to a step 53 where the CPU determines fourth feed amounts for the work table 21 and the wheel head 27 to effect movement of the apex portion Gp of grinding wheel G along the ground surface Sc of rounded annular corner Wc from the terminal point $P_1$ to the start point $P_0$. Thus, the pulse generator 42 distributes pulses to the drive units DUX and DUZ in response to output signals indicative of the fourth feed amounts from the CPU to effect relative movement between the work table 21 and the wheel head 27 for moving the apex portion Gp of grinding wheel G along the ground surface Sc of rounded annular corner Wc of workpiece W toward the start point $P_0$. When the apex portion Gp of grinding wheel G has been returned to the starting point Po, the program will end to finish the grinding cycle.

Figure 6:
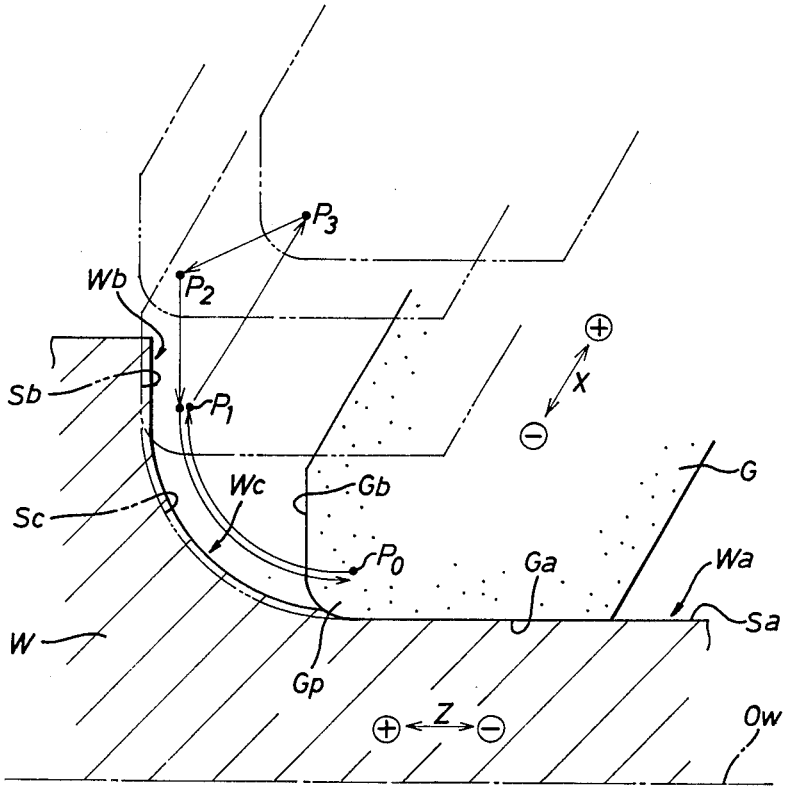
FIG. 6 illustrates a modification of the grinding method shown in FIG. 5.

In FIG. 6 there is illustrated a modification of the foregoing grinding method, wherein after moved to the terminal point $P_1$, the apex portion Gp of grinding wheel G is radially outwardly retracted to an intermediate escape point $P_3$ in the X-axis direction and is subsequently moved to the terminal point $P_1$ through the escape point $P_2$. The other moving cycle of grinding wheel G is substantially the same as that of grinding wheel G in the foregoing embodiment. Although the above embodiment and modification have been adapted to a grinding machine having a grinding wheel movable in a direction extending across the axis of a workpiece at an acute angle, the grinding method of the present invention may be adapted to a grinding machine having a grinding wheel movable in a direction extending perpendicular to the axis of a workpiece.

Having now fully set forth both structure and operation of the preferred embodiments of the concept underlying the present invention, various other embodiments as well as certain variations and modifications of the embodiments herein shown and described will obviously occur to those skilled in the art upon becoming familiar with the underlying concept. It is to be understood, therefore, that within the scope of the appended claims, the invention may be practiced otherwise than as specifically set forth herein.

What is claimed is:

1. A method of grinding a rounded annular corner formed between cylindrical and shoulder portions of a workpiece, the method comprising the steps of:

rotating the workpiece about a first axis coinciding with the longitudinal axis thereof;

providing a grinding wheel having cylindrical and shoulder grinding surfaces for respectively grinding the cylindrical and shoulder portions of the workpiece, said grinding wheel also having apex portion formed between the cylindrical and shoulder grinding surfaces for grinding the rounded annular corner of the workpiece;

rotating said grinding wheel about a second axis extending across the first axis;

positioning said grinding wheel at a starting point where said grinding wheel is in contact at the cylindrical grinding surface with the workpiece cylindrical portion and at the shoulder grinding surface with one end of the rounded annular corner adjacent to the workpiece cylindrical portion;

effecting first relative movement between the rotating grinding wheel and the rotating workpiece for moving the apex portion of the grinding wheel along the rounded annular corner from the starting point to a terminal point where the workpiece shoulder portion is ground by the shoulder grinding surface of said grinding wheel;

effecting second relative movement between the rotating grinding wheel and the rotating workpiece for retracting said grinding wheel radially outwardly of the workpiece from the terminal point to an escape point where the shoulder grinding surface is out of contact with the workpiece shoulder portion;

effecting third relative movement between the rotating grinding wheel and the rotating workpiece for returning said grinding wheel from the escape point to the terminal point; and effecting fourth relative movement between the rotating grinding wheel and the rotating workpiece for moving the apex portion of the grinding wheel from the terminal point to the starting point along the rounded annular corner of the workpiece.

2. A grinding method as set forth in claim 1, wherein the escape point is located at a position spaced radially outwardly from the outer periphery of the workpiece shoulder portion in a direction perpendicular to the first axis so that when the grinding wheel is at the escape point, the shoulder grinding surface is within the same plane as the shoulder surface of the workpiece.

3. A grinding method as set forth in claim 2, wherein the step of effecting the second relative movement is arranged to retract said grinding wheel radially outwardly from the terminal point to an intermediate escape point where the shoulder grinding surface is spaced from the shoulder portion of the workpiece in a direction extending across the first axis at an acute angle and subsequently moving said grinding wheel from the intermediate escape point to the escape point.

* * * * *